United States Patent [19]

Renaud et al.

[11] 4,052,256

[45] Oct. 4, 1977

[54] METHOD OF DISPERSING GLASS FIBERS USING A LINEAR POLYSILOXANE AND DISPERSION OBTAINED THEREBY

[75] Inventors: Laurent C. Renaud, Pittsfield, Mass.; Clarence W. Charon, Newark, Ohio

[73] Assignee: Owens-Corning Fiberglas Corporation, Toledo, Ohio

[21] Appl. No.: 655,175

[22] Filed: Feb. 4, 1976

Related U.S. Application Data

[63] Continuation of Ser. No. 493,361, July 31, 1974, abandoned.

[51] Int. Cl.[2] ..... D21D 3/00

[52] U.S. Cl. ..... 162/145; 65/3 C; 162/156; 162/164 R; 162/168 R; 162/168 N; 162/181 R; 162/181 A; 162/181 D; 162/183; 162/DIG. 3

[58] Field of Search ..... 162/145, 156, 164 R, 162/181 A, 181 C, 181 D, 158, 181 R, 183, 168 R, 168 N, DIG. 3; 65/3 C

[56] References Cited

U.S. PATENT DOCUMENTS

| | | | |
|---|---|---|---|
| 2,510,661 | 6/1950 | Safford | 162/158 |
| 2,919,221 | 12/1959 | Labino | 162/156 |
| 3,046,160 | 7/1962 | Dengler | 162/164 R X |
| 3,240,663 | 3/1966 | Raczek | 162/164 R X |
| 3,395,071 | 7/1968 | Nitzsche et al. | 162/156 X |
| 3,573,158 | 3/1971 | Pall et al. | 162/156 X |
| 3,749,638 | 7/1973 | Renaud et al. | 162/145 |

*Primary Examiner*—Arthur L. Corbin
*Attorney, Agent, or Firm*—Ronald C. Hudgens; Philip R. Cloutier; Dennis M. Kozak

[57] ABSTRACT

Dispersions of glass fibers are produced by agitating a mixture comprising water, glass fibers and a water solution of a linear polysiloxane containing at least 6 silicon atoms, each of said silicon atoms having 2 non-hydrolyzable oleophilic groups attached thereto.

5 Claims, No Drawings

METHOD OF DISPERSING GLASS FIBERS USING A LINEAR POLYSILOXANE AND DISPERSION OBTAINED THEREBY

This is a continuation of Application Ser. No. 493,361 filed July 31, 1974, now abandoned.

BACKGROUND OF THE INVENTION

The paper-making art has long sought to add dispersions of glass fibers to dispersions of wood pulp for the purpose of increasing the strength of the resulting paper. Glass fibers are made in generally continuous lengths and are chopped at various lengths, usually ¼ inch to 2 inches for such applications. Dispersions of these relatively long length glass fibers greatly increase the strength of wood pulp paper. It is known that wood pulp fibers once dispersed throughout the glass fibers, help hold the glass fibers in suspension so that this combination has been looked upon by the art as having great merit, if it could be made at a near neutral pH.

Prior to the development in our previous application Ser. No. 105,713, now U.S. Pat. No. 3,749,638 there had been no way that textile glass fibers made of E-glass could be dispersed at a pH greater than approximately 2.9. Such dispersions have been too acidic for paper-making machinery which are made principally of copper-bearing materials. In our previous work we found that dispersions of E-glass fibers could be produced at pH's greater than 2.9 providing that clay or sodium metaphosphate was present in the dispersing media. This discovery, therefore, made papers formed by the mixture of pulp and glass fibers a commercial possibility. It also made it possible to produce papers made completely from glass fibers, since the paper dispersions themselves could be produced at a pH greater than 3.5.

There were, however, some applications particularly where microfibers were used having diameters as defined as beta, A, AA, AAA, AAAA, and AAAAAA diameters, wherein the clays would be retained in papers made of these tiny fibers. In filter applications, for example, the pores between the fibers would be so small as to retain the clay from the slurry, and the clay particles, therefore, would partially plug up the pores of the filter produced. In still other applications, chelating agents must be added of the water that are used for making the paper slurries for the removal of ions of iron, and the sodium metaphosphate used as a suspending agent, interfers with the chelating effect that is produced with the iron ions.

An object of the present invention, therefore, is the provision of still other materials which can be used as suspending agents for glass fibers in water, which agents preferably will not be particulates or interfere with chelating agents.

Further objects and advantages will become apparent to those skilled in the art to which the invention relates from the following description of the preferred embodiments.

DESCRIPTION OF THE PREFERRED EMBODIMENTS

It has now been discovered that water dispersible long chain polysiloxanes having two non-hydrolyzable groups on each of the silicon atoms, and which chains contain at least 6 silicon atoms can be used as a dispersing aid for glass fibers. Not all silanes can be used, and those siloxanes which crosslink into polymerized bodies are not effective. Since the discovery was made, it appears that the linear polysiloxanes are, in some manner, attracted to positions between the suspended glass fibers; and because of their non-hydrolyzable oleophilic radicals do not move to the surface of the glass fibers as is the case with mono substituted silane-coupling agents. It appears that the oxygen of the linear polysiloxane chains will hold hydrogen ions in their vicinity in the acid mediums used to thereby become positively charged. The glass fibers in an acid medium apparently hold hydrogen ions in a layer over their surfaces, and it now appears that the positively charged long chain polysiloxanes when positioned between the fibers provides an additional repelling force to hold the glass fibers spaced apart. The phenomena can be used to increase the concentrations of glass fibers which are suspended at any particular pH level, or they can be used to permit an increase in the pH of the suspending medium, or they can be used to achieve a combination of both. Some glass fiber compositions are dispersed more easily than others, but the polysiloxanes of the present invention can be used as a dispersing aid for any glass fiber composition.

EXAMPLE 1

High efficiency paper fibers can be made from microfibers of the AAA and AA diameters, but these fibers are difficult to produce and are costly. What is more, the strength of the filter papers can be increased by the addition of larger size fibers, as for example, beta fibers, but it is difficult to blend dispersions of these fibers, or to produce a dispersion of the mixture in the first instance. The present invention makes it possible to produce dispersions of the mixtures without appreciable difficulty. A dispersion is made of the following materials:

| Ingredients | Parts |
|---|---|
| Tap water at 90° F. | 44 lbs. |
| Beta fibers having a chopped length of ¼ inch | 35 grams |
| Sulphuric acid to produce 2.3 pH | — |
| Polyvinylalcohol fibers | 0.75 grams |
| AA microfibers | 21.5 grams |
| AAA microfibers | 43.3 grams |
| Polymethylmethacrylate emulsion (55% solids) | 5 ccs. |
| Dimethylpolysiloxane | 2 drops |

The above materials were blended in a Valley beater for 30 minutes and a stable dispersion of the fibers was produced. The dispersion was drained through a 60 mesh paper-making screen to cast a paper weighing 3.402 ounces per square yard. The paper had a very smooth surface, was 27 mils thick, and had an air permeability of 5.22 cubic feet per minute per square foot.

EXAMPLE 2

The process of Example 1 was repeated using the following ingredients:

| | |
|---|---|
| Tap water | 30 liters |
| Sodium hexametaphosphate | 15 grams |
| Polyvinylalcohol fibers | 3 grams |
| ¼ inch Beta E-glass fibers | 30 grams |
| AAA microfibers | 75 grams |
| AA microfibers | 45 grams |
| Dimethylpolysiloxane | 2 drops |

It will be seen that no acid was used in this formulation and the pH was approximately 7. This formulation gave a paper having substantially the same properties as did the materials of Example 1.

Various dispersions have been made to test the efficiency of the linear polysiloxanes as dispersing agents.

EXAMPLE 3

One liter of water was added to a beaker and sulphuric acid was added to adjust the pH to 3.3. Five grams of Beta E-glass fibers of ¼ inch length (3.5 micron in diameter) was added and 5 grams of dimethylpolysiloxane was added. The material was stirred using a glass rod to disperse the fibers and a complete dispersion was obtained suitable for making paper.

EXAMPLE 4

The process of Example 3 was repeated excepting that no siloxane was used, but the fibers could not be beat into an unagglomerated stable dispersion.

EXAMPLE 5

The process of Example 4 was repeated excepting that ¼ inch long E-glass fibers of C-diameter (0.0015 – 0.00020 inch in diameter) were substituted, and these fibers likewise could not be beat into a dispersion.

EXAMPLE 6

The process of Example 3 was repeated excepting that the C-diameter fibers of Example 5 were substituted for the Beta fibers, and a suitable dispersion was produced.

EXAMPLE 7

A liter of tap water was placed in a beaker along with 5 grams of ¼ inch Beta E-glass fibers, ½ gram of sodium hexametaphosphate, and 5 grams of dimethylpolysiloxane. The mixture had a pH of 7, and an acceptable stable dispersion was made when beat with a stainless steel rod.

EXAMPLE 8

One liter of water was added to a beaker along with 5 grams of ¼ inch Beta E-glass fibers, 1 ½ grams of hydroaluminasilicate clay, 5 grams of dimethylpolysiloxane, and enough hydrochloric acid to adjust the pH to 3.3. This material, when beat with a stainless steel rod, formed a stable dispersion.

EXAMPLE 9

The process of Example 8 was repeated excepting that 5 grams of gamma amino propyltrimethoxysilane was added, and it was found that the fibers agglomerated.

EXAMPLE 10

The process of Example 9 was repeated excepting that 5 grams of methacryloxypropyltrimethoxysilane was substituted for the gamma amino propyltrimethoxysilane and the materials did not agglomerate.

EXAMPLE 11

The process of Example 3 was repeated excepting that a diphenylpolysiloxane was substituted for the dimethylpolysiloxane and a stable dispersion of the fibers was produced.

EXAMPLE 12

The process of Example 3 was repeated excepting that methylpropylpolysiloxane was substituted for the dimethylpolysiloxane and a stable dispersion was produced.

EXAMPLE 13

A dispersion was made of 5 grams of AA C-glass fibers in 1 liter of water at a pH of 6.8. Another dispersion was made of 5 grams of ¼ inch Beta E-glass fibers at a pH of 6.8. The two dispersions were mixed together in a stainless steel pail and the fibers thereof agglomerated.

EXAMPLE 14

The process of Example 13 was repeated excepting that 5 grams of dimethylpolysiloxane was added to the dispersion of the AA microfibers before adding to the dispersion of the Beta fibers and when the two were blended together no agglomeration took place. It has been found that the polysiloxane can be used in the dispersion of the Beta fibers, or can be present in the water to which both of the dispersions are added with the same effect.

EXAMPLE 15

It has been found that one drop of the linear polysiloxane in 1 liter of water produces a recognizable dispersible effect on the fibers. The effect appears to increase with the amount of linear polysiloxane added and the upper limit will usually be dictated by economic considerations.

Five grams of ¼ inch Beta E-glass fibers were added to a liter of water in a beaker at a pH of 7. Drops of dimethylpolysiloxane were slowly added with stirring and after 30 drops were added with mixing the fibers dispersed into a stable dispersion.

EXAMPLE 16

The process of Example 3 was repeated excepting that methacryloxypropyltrimethoxysilane was substituted for the dimethylpolysiloxane, and a stable dispersion could not be made.

EXAMPLE 17

The pH of the slurry of Example 1 was adjusted to 4.5 pH with ammonium hydroxide. Amounts of heavily beaten wood pulp up to 15 percent by weight of the slurry were added with mixing without reagglomeration of the slurry or degradation of the wood pulp. All make papers of good quality.

It has been found that any non-ionizable binder can be used with the fiber dispersions in order to cast papers therefrom. Such binders will include carboxyl methylcellulose, polyvinylalcohol, gelatin, hydroxymethylcellulose, sodium alginate, acrylic emulsions, etc.

The above examples show that linear polysiloxanes having 6 or more S10 groups will act as dispersing agents for glass fibers by themselves or in conjunction with acids, clays, or sodium hexametaphosphate, multivalent ions normally used to increase the zeta potential of glass fibers. Different glass compositions appear to disperse under slightly different conditions, but the linear polysiloxanes aid in the dispersing of any diameter fibers of any glass composition, and can be used either by themselves, or in conjunction with, or as a replacement for acids, alkalis, clays, or hexamethylphosphate salts. The linear polysiloxane dispersing materials have been used with E-glass, C-glass, S-glass, K-glass, zirconia glass, and soda glass compositions, and it was found that a dispersing effect was produced in each instance. It can, therefore, be said that linear polysiloxanes having 2 non-hydrolyzable oleophilic groups on each silicon atom thereof are effective to disperse any glass composition provided mono substituted silane or siloxane materials are not present in interferring amounts which coat the surfaces of the fibers.

While the invention has been described in considerable detail, we do not wish to be limited to the particular embodiments shown and described, and it is our intention to cover hereby all novel adaptations, modifications, and arrangements thereof which come within the practice of those skilled in the art to which the invention relates.

We claim:

1. In the process of dispersing glass fibers in an aqueous solution, the improvement comprising:

vigorously agitating a mixture comprising water, glass fibers and an effective amount of a water solution of a linear polysiloxane containing at least 6 silicon atoms, each of said silicon atoms having 2 non-hydrolyzable oleophilic groups attached thereto, to uniformly disperse said glass fibers in said water.

2. The process of claim 1 in which said polysiloxane is selected from the group consisting of dimethylpolysiloxane, methylpropylpolysiloxane and methacryloxypropyltrimethoxysilane.

3. The process of claim 1 in which said mixture comprises an acid.

4. The process of claim 1 in which said mixture comprises clays or hexametaphosphate salts.

5. An aqueous dispersion consisting essentially of:

a. water;

b. glass fibers;

c. cellulose fibers; and, d. an effective amount of a linear polysiloxane, containing at least 6 silicon atoms and having 2 non-hydrolyzable oleophilic groups affixed to each of said silicon atoms, to hold said fibers dispersed throughout the water.

* * * * *